US005524512A

United States Patent [19]

Wolfe

[11] Patent Number: 5,524,512

[45] Date of Patent: Jun. 11, 1996

[54] DRYWALL SCREWDRIVER DEPTH ADJUSTMENT

[75] Inventor: Jack Wolfe, Lantau Island, Hong Kong

[73] Assignee: Ryobi Motor Products Corp., Easley, S.C.

[21] Appl. No.: 212,240

[22] Filed: Mar. 11, 1994

[51] Int. Cl.[6] ..... B25B 23/00

[52] U.S. Cl. ..... 81/429; 81/475; 81/57.14

[58] Field of Search ..... 81/429, 57.14, 81/436, 467, 469, 451, 473, 474, 475

[56] References Cited

U.S. PATENT DOCUMENTS

| | | | |
|---|---|---|---|
| 2,940,488 | 6/1960 | Riley, Jr. | 81/429 |
| 3,460,408 | 8/1969 | Raymond . | |
| 3,527,273 | 9/1970 | Falter . | |
| 4,287,923 | 9/1981 | Hornung . | |
| 4,592,257 | 6/1996 | Dürr . | |
| 4,647,260 | 3/1987 | O'Hara et al. . | |
| 4,762,035 | 8/1988 | Fushiya et al. . | |
| 4,766,783 | 8/1988 | Stanich et al. . | |
| 4,803,904 | 2/1989 | Stanich et al. . | |
| 5,044,233 | 9/1991 | Tatsu et al. . | |
| 5,094,133 | 3/1992 | Schreiber . | |
| 5,101,698 | 4/1992 | Paradiso . | |

*Primary Examiner*—D. S. Meislin
*Attorney, Agent, or Firm*—Brooks & Kushman

[57] ABSTRACT

A power hand tool for driving a fastener a desired depth into a workpiece. The power tool includes a depth adjust sleeve for varying a resulting driving depth of the fastener into the workpiece. A depth indicator is included to allow a user to gauge the resulting driving depth of the fastener into the workpiece based on his adjustment of the depth adjust sleeve. In one embodiment, the depth indicator comprises a marker coupled to the depth adjust sleeve such that its location varies monotonically in response to varying the resulting driving depth, a lens to allow the marker to be clearly seen by the user, and a scale to which the location of the marker is compared. A driving mechanism is then used for driving the fastener into the workpiece until the resulting driving depth is attained.

3 Claims, 6 Drawing Sheets

DRYWALL SCREWDRIVER DEPTH ADJUSTMENT

TECHNICAL FIELD

This invention relates to power hand tools, and more particularly, to power screwdrivers which limit the depth that a screw is driven.

BACKGROUND ART

There are many applications which prescribe, in general terms, that a fastener be driven a fixed distance into a workpiece. One such application arises when securing sections of drywall sheathing material to wall studs using drywall screws. In this application, it is desired that each drywall screw be driven until the screw head is substantially flush with the drywall surface or the head is a predetermined distance below the drywall surface. If the screw is under-driven, the screw head protrudes from the drywall surface. This yields a undesirable bulge in the wall at the location of the screw. If the screw is over-driven, the screw head penetrates into the drywall. An over-driven screw can cause damage to the drywall, such as cracking.

To facilitate rapid fastening of drywall sections to studs, a handheld power screwdriver is employed. Although a standard power screwdriver can increase the rate at which drywall screws are fastened, it does not include means for driving the screw until the head is flush with the surface.

The need to control the depth at which a fastener is driven into a workpiece precipitated the advent of a depth adjusting device for a power screwdriver. Many of these depth adjusting devices comprise a front end which contacts, or engages, the workpiece. U.S. Pat. No. 3,527,273 to Falter discloses a tool having such a depth adjusting device in which a clutch disengages to terminate rotation once a bit reaches a predetermined position with respect to a tool housing. U.S. Pat. No. 4,592,257 to Durr discloses a depth adjusting device having a depth stop that is robust to operational disturbances.

Although the apparatuses disclosed in the cited references include means for adjusting the driven depth of a fastener, they do not include means for gauging the depth that will result based on an adjustment. Therefore, the process of adjusting the stop depth to a desired location is iterative. One must first make an initial depth adjustment followed by driving a first fastener. Next, a second depth adjustment is made based on an eyeballing of the depth of the first fastener within the workpiece followed by driving a second fastener. This process of adjusting the depth and driving fasteners is repeated until the desired depth is attained.

SUMMARY OF THE INVENTION

It is thus a general object of the present invention to provide a depth indicator for gauging a resulting driving depth of a fastener into a workpiece in a power hand tool having a depth adjustment device.

A specific object of the present invention is to provide a visual scale for gauging a resulting driving depth of a screw into a workpiece in a power screwdriver having a screwdriver depth adjustment device.

In carrying out the above objects, the present invention provides a power hand tool for driving a fastener into a workpiece. The tool comprises depth adjustment means for varying a resulting driving depth of the fastener into the workpiece. A depth indicator means responds to the depth adjustment means for gauging of the resulting driving depth of the fastener. A driving mechanism, which is also responsive to the depth adjustment means, drives the fastener into the workpiece until the resulting driving depth is attained.

In carrying out the above objects, the present invention further provides a power screwdriver for driving a screw into a workpiece. The screwdriver comprises a housing which substantially encloses the power screwdriver. A depth adjust sleeve, having threads which engage with mating threads of the housing to allow axial displacement of the sleeve with respect to the housing by rotation of the sleeve with respect to the housing, allows a resulting driving depth of the screw into the workpiece to be varied. A nose is coupled to the depth adjust sleeve to displace axially therewith. The screwdriver further comprises a marker, coupled to the depth adjust sleeve, having an axial location with respect to the housing and a scale, mounted to the housing in visual proximity to the marker, to which the axial location of the marker is compared for gauging the resulting driving depth of the screw into the workpiece. A motor, having a motor shaft, is powered to provide a source of rotational power to the motor shaft. A clutch mechanism transmits rotational power from the motor shaft to an output shaft coupled to the screw for driving the screw into the workpiece. The clutch mechanism disengages transmission of rotational power from the motor shaft to the output shaft when the nose is in contact with the workpiece for inhibiting further driving of the screw into the workpiece.

These and other features, aspects, and advantages of the present invention will become better understood with regard to the following description, appended claims, and accompanying drawings.

DETAILED DESCRIPTION OF THE INVENTION

Figure 1:
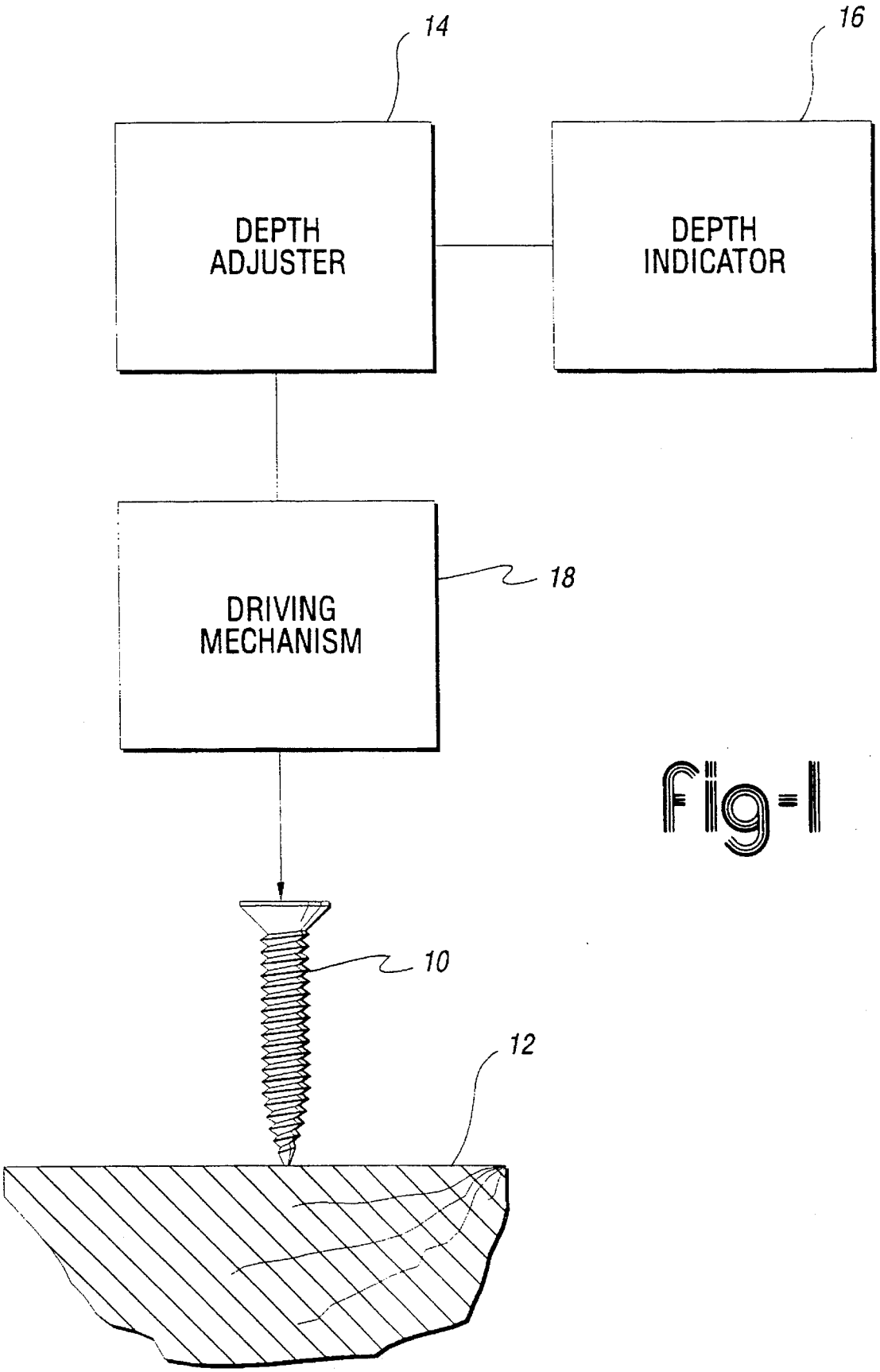
FIG. 1 is a block diagram of a power hand tool embodiment of the present invention.

Referring to FIG. 1, a block diagram is shown for a power hand tool embodiment of the present invention for driving a fastener 10 into a workpiece 12. The workpiece 12, in general, comprises at least one workpiece which are to be fastened together by the fastener 10. The power hand tool comprises a depth adjustment device in block 14 which provides means for varying a resulting driving depth of the fastener 10 into the workpiece 12. The tool further comprises a depth indicator in block 16 which provides means for gauging the resulting driving depth of the fastener 10 based upon a setting of the depth adjustment device 14. Using the setting of the depth indicator 16, a driving mechanism in block 18 is then employed for driving the fastener 10 into the workpiece 12 until the resulting driving depth is attained.

Figures 2A, 2B:
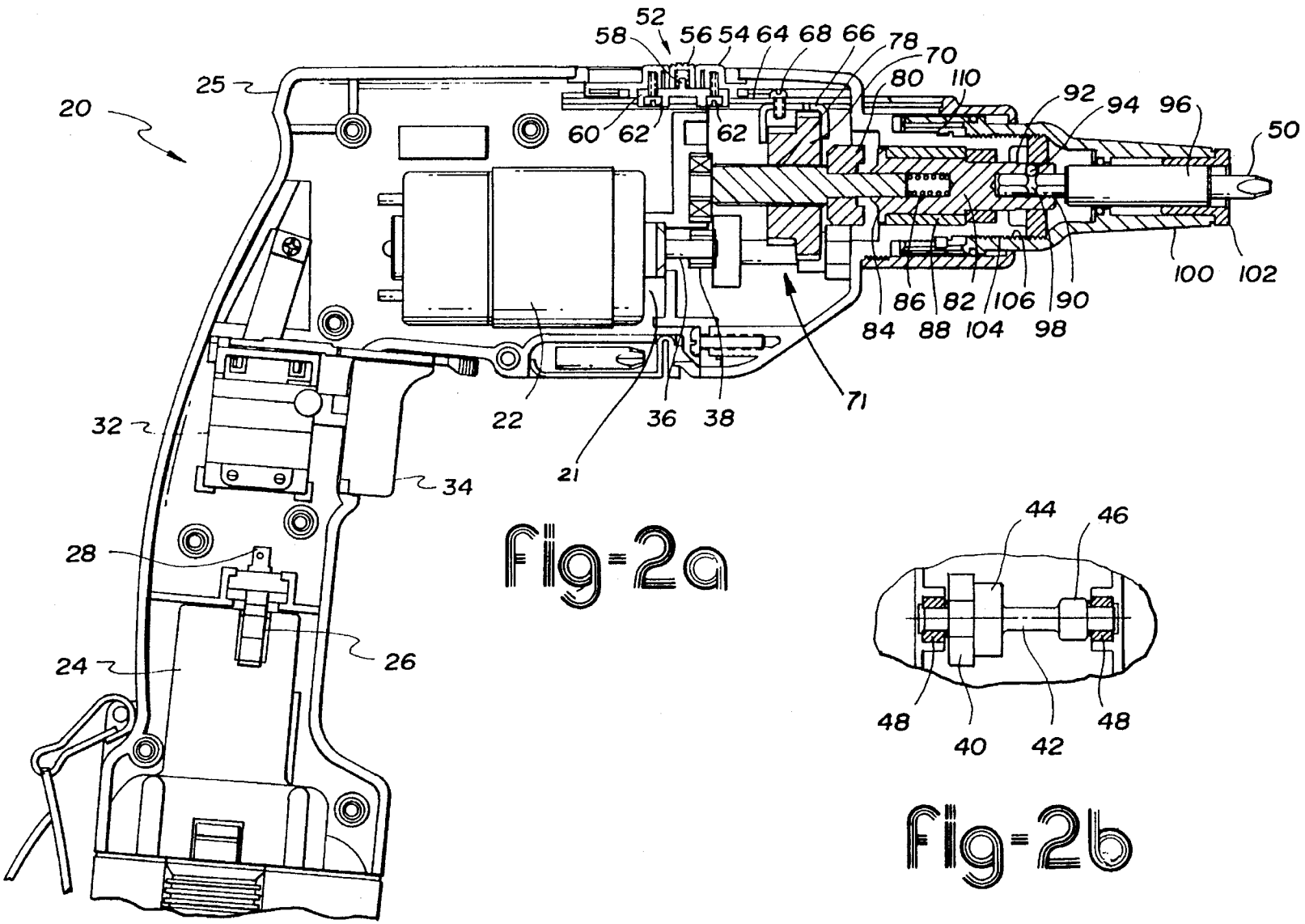
FIG. 2(*a–b*) are side detail views of a screwdriver embodiment of the present invention.

A power screwdriver apparatus 20 embodying the present invention is shown in FIG. 2. The power screwdriver apparatus 20 comprises a driving mechanism 21 for driving the fastener into the workpiece. The rotational driving power of the driving mechanism 21 originates from a motor 22 powered by a power pack assembly 24, both within an apparatus housing 25. The housing 25 substantially encloses the screwdriver driver apparatus 20. The terminals 26 of the power pack assembly 24 mate with corresponding contact plates 28. The contact plates 28 are electrically connected to inputs of a variable switch 32. Outputs of the variable switch 32 are connected to powering terminals of the motor 22. An application of electrical power to the motor 22 is initiated in response to a squeezing of a trigger 34 of the variable switch 32, whereby the amount of power applied to the motor is dictated by the depression of the trigger 34.

The application of electrical power to the motor 22 causes rotational motion of a motor shaft 36. A pinion gear 38, located at the tip of the motor shaft 36, is mounted to the motor shaft 36 to rotate therewith. The pinion gear 38 meshes with a driving gear 40, rotatably mounted to a gear shaft 42, to transfer rotational power to the gear shaft 42. The gear shaft 42 further has mounted thereto for rotation a high speed gear 44 and a low speed gear 46. The high speed gear 44 and low speed gear 46 are axially separated along the gear shaft 42. The gear shaft 42 is both axially and radially fixed with respect to the housing 25 by bushings 48.

The rotational speed and torque of a bit 50 is adjustable by a gear change mechanism 52. The gear change mechanism 52 comprises a speed change knob 54 within which a speed change lock 56 is sandwiched. A speed change spring 58 provides an outward force to the speed change lock 56 to keep a speed setting intact. An external application of force opposing the spring force displaces the lock 56 into the housing 25 which allows sliding, axial motion of the speed change knob 54. The speed change knob 54 is fastened to a switch bracket 60 by two screws 62. The switch bracket 60 is coupled to a shift plate 64. The shift plate 64 is fastened to a carrier 66 by screw 68. The carrier 66 clasps the faces of an output gear 70. The resulting mechanism allows an axial stroke movement of the output gear 70 in response to axial movement of the speed change knob 54.

Figure 3:
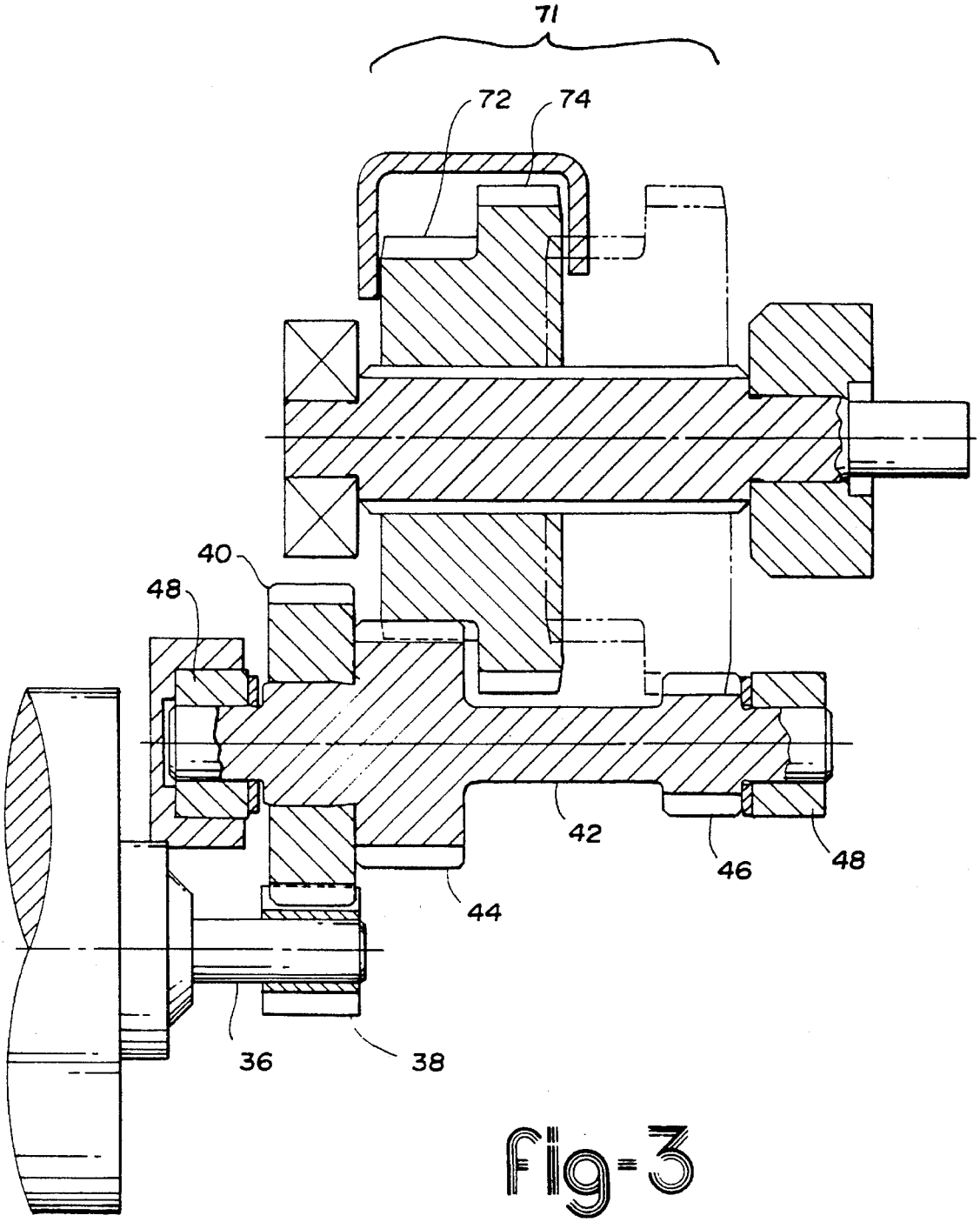
FIG. 3 is a magnified view of the gear train of the screwdriver embodiment.
Figure 4:
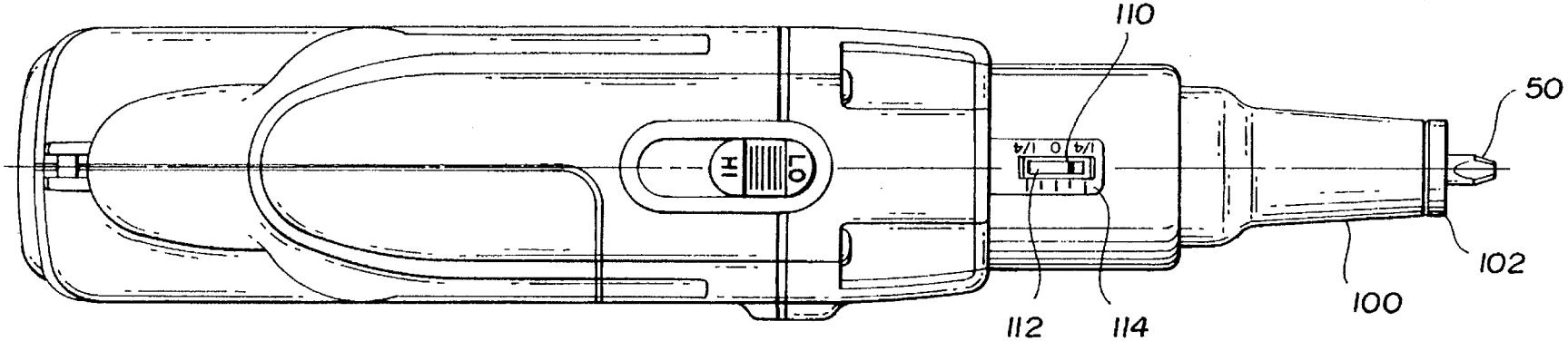
FIG. 4 shows a top view of the screwdriver embodiment of the present invention.
Figure 5A:
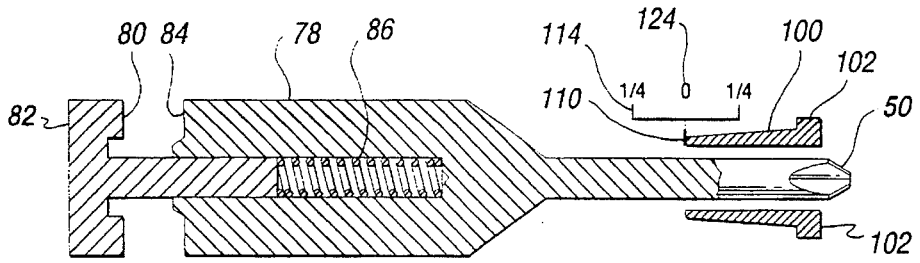
FIG. 5(*a–d*) are schematic representations of side views of the screwdriver embodiment of the present invention while driving a flat heat screw.
Figure 5B:
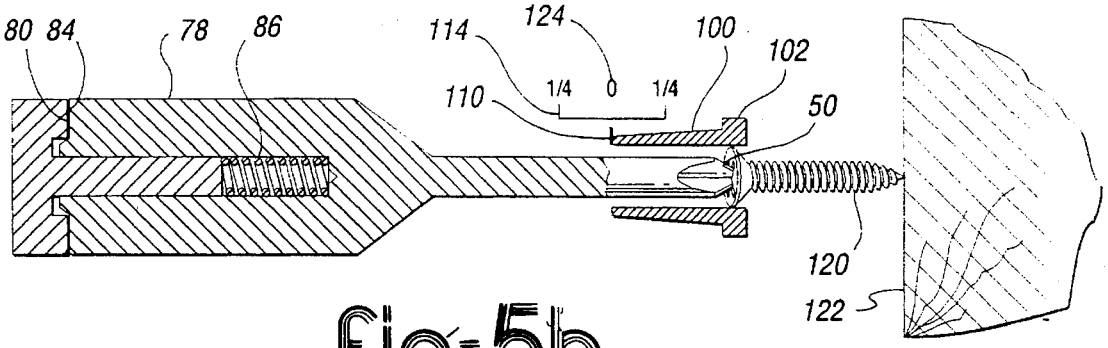
Figure 5C:
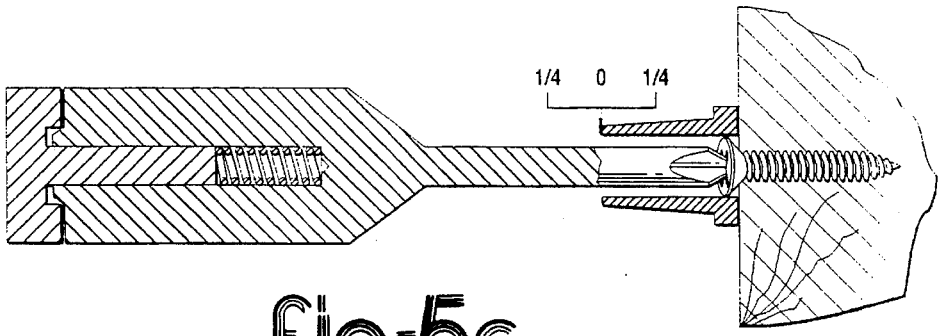
Figure 5D:
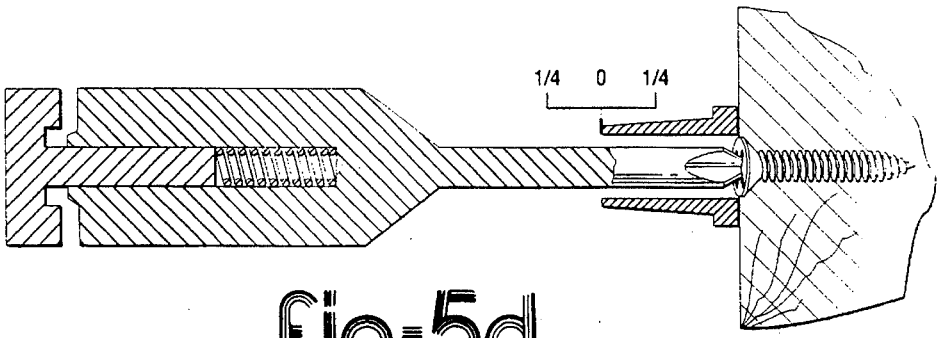
Figure 6A:
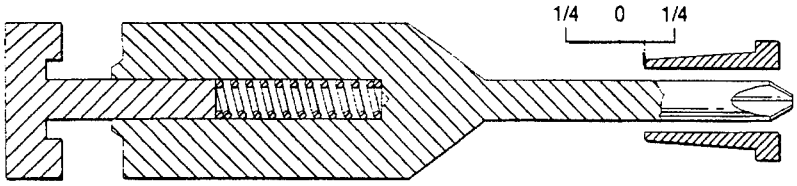
FIG. 6(*a–d*) are schematic representations of side views of the screwdriver embodiment of the present invention while driving a round head screw.
Figure 6B:
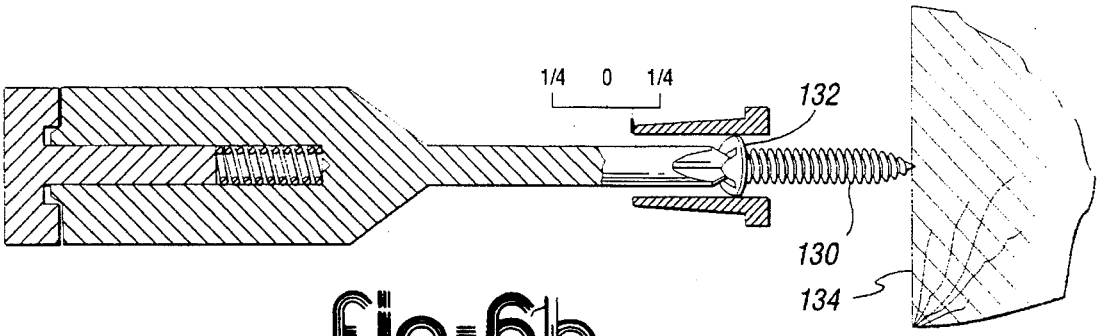
Figure 6C:
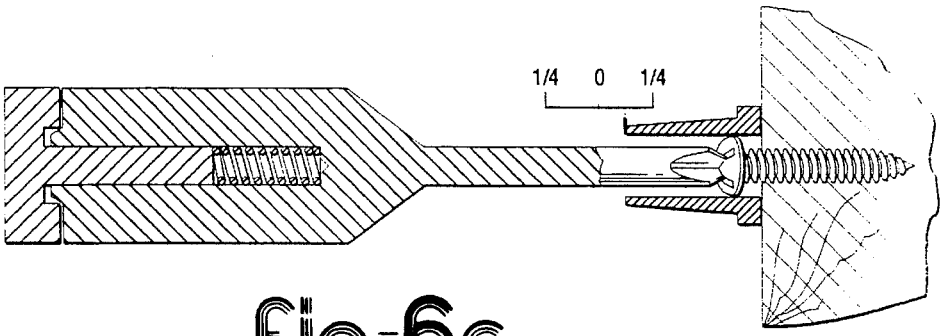
Figure 6D:
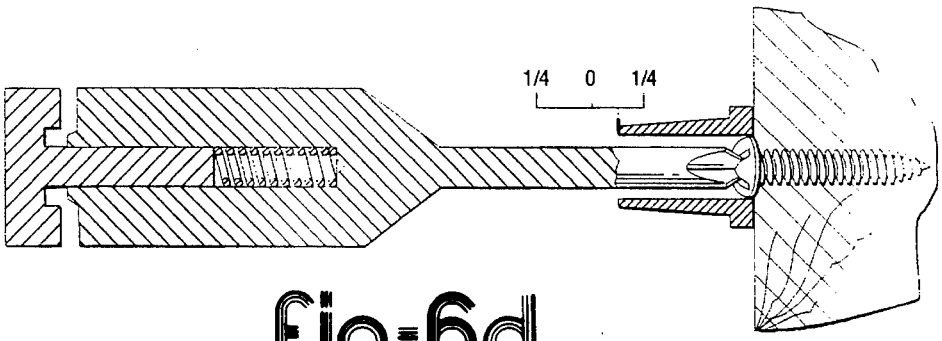

FIG. 3 shows a magnified view of a resulting gear train 71 within the screwdriver apparatus 20. The output gear 70 comprises two gears: a high output gear 72 and a low output gear 74. The high and low output gears 72 and 74 are constructed to have radii which mesh with the corresponding high speed and low speed gears 44 and 46 of the gear shaft 42. When the speed change knob 54 is fully extended forward (toward the bit 50) as is shown in FIG. 2, the low speed gear 46 meshes with the low output gear 74. When the speed change knob is fully extended rearward (toward the handle 76) as is shown in FIG. 3, the high speed gear 44 meshes with the high output gear 72.

Referring back to FIG. 2, the output gear 70 of the gear train 71 is mounted to be axially displaceable, but rotationally coupled to a driving shaft 78. The driving shaft 78 includes a clutch plate 80 mounted thereon for rotation. An output shaft 82, used to transmit rotational motion to the bit 50, is aligned along the axis of the driving shaft 78. A flange 84 is located at the rear of the output shaft 82 to provide transmission of rotational motion to the output shaft 82 when engaged with the clutch plate 80. A spring clutch 86 is mounted between the front end of the driving shaft 78 and rear end of the output shaft 82 to bias the flange 84 away from the clutch plate 80, resulting in a bias of transmission disengagement. Bushing 88 secures the radial positioning of the output shaft 82 while allowing both full angular and limited axial displacement of the output shaft 82 with respect to the housing 25.

The front of the output shaft 82 contains an opening 90 to accommodate the insertion of the screwdriver bit 50. Within this opening is contained a spring ring 92 and a steel ball 94 for securing of the screwdriver bit 50. The bit 50 is axially inserted into a cylindrical magnetic holder 96. During insertion, the rear end of the bit 50 passes through the magnetic holder into the opening 90 at the front end of the output shaft. The terminating axial position of the bit 50 is reached when the steel ball 94 is pressed into a concave annular groove 98 at the rear end of the bit 50. The force applied by the spring ring 92 to the steel ball 94 into the groove 98 secures the axial positioning of the bit 50 with respect to the output shaft 82. In the operating position of the bit 50, a portion of the length of the bit 50 is radially enclosed by the magnetic holder 96.

The embodiment of the present invention further comprises a depth adjust sleeve 100 to provide means for varying the resulting driving depth of the fastener into the workpiece. The depth adjust sleeve 100 has threads 104 located on the interior thereof which engage with mating threads 106. The mating threads 106 are mechanically coupled to the housing 25 to constrain a fixed position of the mating threads 106 with respect to the housing 25. The position of the depth adjust sleeve 100 is thus axially displaceable with respect to the housing by rotation of the sleeve 100 with respect to the housing 25. A nose 102 is coupled to the sleeve 100 so that the axial position of the nose 102 follows the axial position of the sleeve. The nose 102 further has a planar face perpendicular to the bit 50 to provide a flush surface for contact with a receiving member (not shown). The nose 102 acts as a depth stop which allows the driving mechanism to respond to the depth adjust sleeve 100 for driving the fastener into the workpiece until the resulting driving depth is attained (as will be seen later).

A marker 110, located at the rear of the depth adjust sleeve 100, allows for gauging the resulting driving depth of a fastener (not shown). Referring now to the top view of the screwdriver apparatus given in FIG. 3, the marker 110 can be viewed by a user through lens 112. The axial position of the marker 110, which varies monotonically in response to varying the resulting driving depth, can be gauged using a scale 114 located in visual proximity to the marker 110. The combination of the marker 110, lens 112, and scale 114 provides means for gauging the resulting driving depth of the fastener.

One with ordinary skill in the art will recognize that the means for gauging the resulting driving depth of the fastener is not limited to an embodiment having the marker 110 and scale 114. Other analog embodiments of the depth indicator means include a scale located on the sleeve wherein a portion of the scale not covered by the housing allows for depth gauging. The depth indicator means can also be implemented electronically with a transducer responsive to the position of the sleeve connected to either an analog or digital display. Further, one with ordinary skill in the art will recognize that the depth indicator means is not limited to visual gauging.

FIG. 5(*a–d*) shows schematically the use of the screwdriver embodiment of the present invention for driving a flat head screw 120 to be substantially flush with a workpiece 122. First, the depth adjust sleeve 100 is adjusted so that the marker 110 is in line with a "0" indicator 124 on the scale 114 as shown in FIG. 5*a*. Next, the flat head screw 120 is loaded into the bit 50 and forced up against the workpiece 122 as shown in FIG. 5*b*. Here it is shown that the flange 84 of the output shaft 82 is forced into contact with the clutch plate 80, hence compressing the clutch spring 86 which biases the output shaft 82 from the driving shaft 78, while depth adjust marker 110 remains at "0". Rotational power is then applied to the screw 120 by squeezing the trigger (not shown). An application of axial force by the user drives the screw 120 into the workpiece 122 until the nose 102 contacts the workpiece 122 as shown in FIG. 5*c*. At this point, the application of axial force by the user is no longer transmitted solely to the screw 120, but rather is also transmitted through the nose 102 to the workpiece 122. As shown in FIG. 5*d*, the clutch spring 86 then provides force to the screw 120 until the flange 84 and the clutch plate 80 separate. At this point, the transmission of rotational power from the driving shaft 82 to the output shaft 78 ceases. It should be noted that the depth marker 110 remains at "0" throughout this whole process.

FIG. 6(*a–d*) shows schematically the use of the screwdriver embodiment of the present invention for driving a round head screw 130 so that the bottom of the head 132 is substantially flush with a workpiece 134. Suppose, arbitrarily, that the depth of the screw head is ⅛ inches. First, the user would adjust the depth adjust sleeve 100 so that the marker 110 points to the line midway between "0" and "¼" on the scale 114 as shown in FIG. 6*a*. Next, the round head screw 130 is loaded into the bit 50 and forced up against the workpiece 134 as shown in FIG. 6*b*. Once again, the screw-loaded bit pressed against the workpiece 134 initiates contact between the flange 84 of the output shaft 78 and the clutch plate 80. By squeezing the trigger (not shown) and applying an axial force, the screw 130 is driven into the workpiece 134 until the nose 102 contacts the workpiece 134 as shown in FIG. 6*c*. At this point, as shown in FIG. 6*d*, the clutch spring 86 momentarily provides the axial force to the screw 130 until the flange 84 and the clutch plate 80 separate. The transmission of rotational power from the driving shaft 82 to the output shaft 78 ceases thereafter.

The previously described embodiments of the present invention have many advantages, including ease in setting a depth adjust device to produce a desired resulting driving depth.

One with ordinary skill in the art will recognize that the teaching of the present invention can be applied to a variety of hand power tools, and that the present invention should not be construed as being limited to the drywall screwdriver embodiment. For example, a power hand drill embodiment that allows for visual gauging of a resulting drill depth in response to adjusting a means of depth adjustment would follow from the teaching of the present invention.

While the best mode for carrying out the invention has been described in detail, those familiar with the art to which this invention relates will recognize alternative designs and embodiments for practicing the invention defined by the following claims.

What is claimed is:

1. A power screwdriver for driving a screw into a workpiece, the screwdriver comprising;

a housing, substantially enclosing the power screwdriver, the housing having a threaded boss;

a depth adjust sleeve, having threads which engage with the threaded boss of the housing to allow axial displacement of the sleeve with respect to the housing by rotation of the sleeve with respect to the housing, for varying a resulting driving depth of the screw into the workpiece, the depth adjustment sleeve defining a marker formed by a line extending about a least portion thereof.

a nose, coupled to the depth adjust sleeve to displace axially therewith;

a scale sleeve, mounted to the housing in a fixed position relative to the housing and having a window formed therein adjacent to and oriented in visual proximity to the marker, to which the axial location of the marker is compared for gauging the resulting driving depth of the screw into the workpiece, the axial position of the marker varying relative to the window as the depth adjustment sleeve is rotated;

a motor having a motor shaft, powered to provide a source of rotational power to the motor shaft;

an output shaft, rotationally coupled to the screw; and a clutch mechanism, which transmits rotational power from the motor shaft to the output shaft for driving the screw into the workpiece, and disengages transmission of rotational power from the motor shaft to the output shaft when the nose is in contact with the workpiece for inhibiting further driving of the screw into the workpiece.

2. The tool of claim 1 wherein the scale sleeve is provided with a scale indicia, located adjacent the window to which the location of the marker is compared.

3. The tool of claim 1 further comprising:

a lens attached to the scale sleeve extending over the window through which the marker is viewable.

* * * * *